US007841481B2

(12) United States Patent
Gleich

(10) Patent No.: US 7,841,481 B2
(45) Date of Patent: Nov. 30, 2010

(54) MULTICOMPONENT CARTRIDGE ASSEMBLY

(75) Inventor: Alfons Gleich, Gennach (DE)

(73) Assignee: Sulzer Mixpac AG, Haag (CH)

( * ) Notice: Subject to any disclaimer, the term of this patent is extended or adjusted under 35 U.S.C. 154(b) by 488 days.

(21) Appl. No.: 11/978,084

(22) Filed: Oct. 26, 2007

(65) Prior Publication Data

US 2008/0099478 A1 May 1, 2008

(30) Foreign Application Priority Data

Oct. 28, 2006 (DE) ..... 10 2006 050 909

(51) Int. Cl.
*B65D 21/028* (2006.01)

(52) U.S. Cl. ..... 220/23.4; 215/6

(58) Field of Classification Search ..... 220/503, 220/500, 4.16, 4.13, 4.12; 215/10; D9/747, D9/743, 741, 738, 737; *B65D 21/028, 21/024, B65D 21/02*

See application file for complete search history.

(56) References Cited

U.S. PATENT DOCUMENTS

| | | | | | |
|---|---|---|---|---|---|
| 318,909 | A * | 5/1885 | Jones | 169/36 |
| 353,600 | A * | 11/1886 | Sloan | 215/10 |
| 2,825,085 | A * | 3/1958 | Ingraham | 401/19 |
| 3,166,221 | A | 1/1965 | Nielsen | |
| 3,194,426 | A * | 7/1965 | Brown, Jr. | 220/23.4 |
| 3,366,265 | A | 1/1968 | Hesselbarth | |
| 3,788,520 | A * | 1/1974 | Dukess | 222/94 |
| 3,955,715 | A * | 5/1976 | Topor | 222/143 |
| 4,974,756 | A | 12/1990 | Pearson et al. | |
| 5,143,261 | A * | 9/1992 | Drobish | 222/129 |
| 5,249,709 | A | 10/1993 | Duckworth et al. | |
| D385,184 | S * | 10/1997 | Binter | D9/743 |
| 5,735,422 | A * | 4/1998 | Binter | 220/4.21 |
| 5,823,391 | A | 10/1998 | Klauke et al. | |
| 5,890,613 | A * | 4/1999 | Williams | 220/23.4 |
| 2005/0011853 | A1 * | 1/2005 | Brugger | 215/10 |

FOREIGN PATENT DOCUMENTS

| | | |
|---|---|---|
| DE | 197 08 548 A1 | 9/1998 |
| DE | 202 18 244 U1 | 12/2003 |
| DE | 102 38 431 A1 | 3/2004 |
| WO | WO 94/02369 | 2/1994 |

* cited by examiner

*Primary Examiner*—Anthony Stashick
*Assistant Examiner*—Robert J Hicks
(74) *Attorney, Agent, or Firm*—Francis C. Hand; Carella, Byrne, Cecchi

(57) ABSTRACT

The multicomponent cartridge assembly has at least two cartridge containers arranged next to one another and which can be connected to one another via upper and lower connection elements so that they can be plugged together. An additional latch device in the form of interengaging teeth is provided in the region of the upper and/or lower connection elements for the secure holding of the two cartridge containers in the plugged-together state.

11 Claims, 3 Drawing Sheets

MULTICOMPONENT CARTRIDGE ASSEMBLY

This invention relates to a multicomponent cartridge assembly having at least two cartridge containers arranged next to one another. More particularly, this invention relates to a technique for securing the cartridge containers of a multicomponent cartridge assembly together in a secure manner.

As described in U.S. Pat. No. 5,249,709, a multicomponent cartridge assembly is known where two hollow cylindrical cartridge containers that are arranged next to one another can be snapped together by mating pin/receptacle connections at the top and bottom of the containers. For this purpose, a pin and matching receptacle are formed in a transverse web at the cartridge neck of each of the two cartridge containers and are arranged such that the connection pin on one transverse web fits into the receptacle on the other transverse web. A connection pin is likewise provided at the rear end of one cartridge container while a matching receptacle is formed on the other cartridge at the rear end. The connection pins and the associated receptacles are made conical for better holding, but the connection can nevertheless be released relatively simply. In particular, when a blow is exerted on such a multicomponent cartridge assembly, the two cartridge containers can easily be separated on filling, storing or applying. This can result in handling problems or thereby a leak-free connection of the assembly to a static mixer is no longer ensured.

Accordingly, it is the object of the invention to provide a multicomponent cartridge assembly that can be manufactured simply and that ensures a secure connection between the cartridge containers of the assembly.

Briefly, the invention is directed to a multicomponent cartridge assembly comprised of at least two cartridge containers that are disposed next to one another and that are interconnected together by connection elements disposed in longitudinally spaced apart relation on each of the containers.

In accordance with the invention, a latch device is provided in the region of at least one pair of interconnecting connection elements for the secure holding of the cartridge containers in interconnected relation. This additional latch device is provided in the region of the upper and/or lower connection segments for the secure holding of the two cartridge containers in interconnected relation and serves to prevent an unwanted separation of the two cartridge containers after the connecting together.

In an embodiment which is easy to manufacture and cost-effective, the latch device consists of mutually corresponding latch tooth arrangements which are arranged on the two cartridge containers. The mutually corresponding latch tooth arrangements can expediently be attached to mutually facing straight side surfaces at cartridge necks of the two cartridge containers.

The latch tooth arrangements are preferably configured in the manner of a saw tooth arrangement whose teeth have a flatter front side and a steeply falling rear side seen in the direction of movement on the plugging together of the cartridge containers. The cartridge containers can thereby be plugged together simply, but can no longer be separated.

In an expedient embodiment, the lower connection elements are configured for the plugging together of the cartridge containers in the direction of their longitudinal axes and the upper connection elements are configured for the plugging together of the cartridge containers transversely to their longitudinal axes. The cartridge containers are thereby secured both in the longitudinal direction and in the transverse direction.

The upper connection elements expediently consist of a T-shaped nose formed at the one side of a transverse web and a T-shaped groove matching the nose at the other side of the transverse web. However, the connection elements can also be configured in another suitable manner.

Further special features and advantages of the invention result from the following description of a preferred embodiment with reference to the drawings wherein:

FIG. 1 schematically illustrates a multicomponent cartridge assembly in accordance with the invention;

Figure 1:
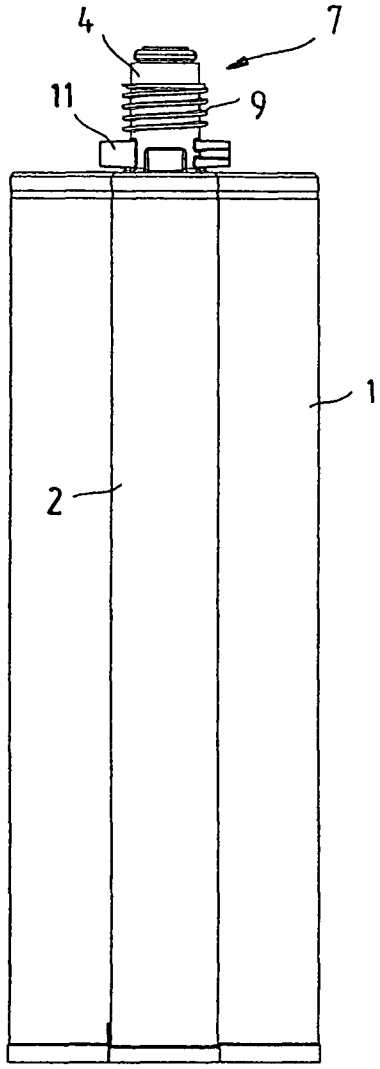

Referring to FIG. 1, the multicomponent cartridge assembly contains two substantially hollow cylindrical cartridge containers 1, 2 which are connected to one another so that they can be plugged together via connection elements explained in more detail in the following.

Figure 2:
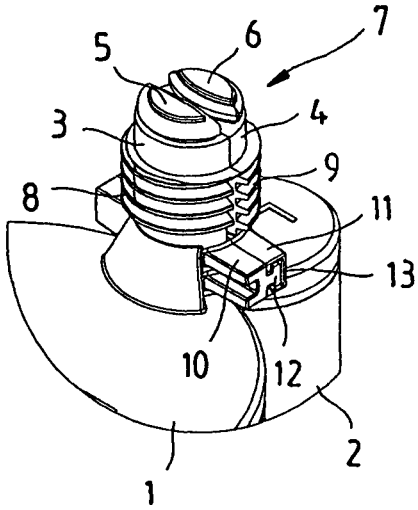
FIG. 2 illustrates a perspective view of the upper part of the multicomponent cartridge assembly of FIG. 1.

Referring to FIG. 2, each cartridge container 1, 2 contains a cartridge neck 3, 4, respectively, at the upper ends configured in the form of a half-cylinder and each having a dispensing opening 5, 6, respectively, of crescent-shaped cross-section. The two cartridge necks 3, 4 are configured such that, in the plugged-together state of the two cartridge containers 1 and 2, they form a support stub 7, which is circular in plan view, for a static mixer or another suitable mixer element.

Each neck 3,4 has an external partial thread 8,9 on the outer side that is complementary to the outer external thread of the other neck 3,4 in the interconnected state of the two cartridge containers 1, 2. A retainer nut, not shown, can be screwed onto this external thread for the fastening of a mixer element, likewise not shown.

Each neck 3,4 also has a transverse web 10,11 beneath the partial threads 8, 9 that extends transversely to the longitudinal axis of the respective cartridge container 1,2. Connection elements 12,13 are arranged on these transverse webs 10,11 for the connection of the two cartridge containers 1,2.

Figure 3:
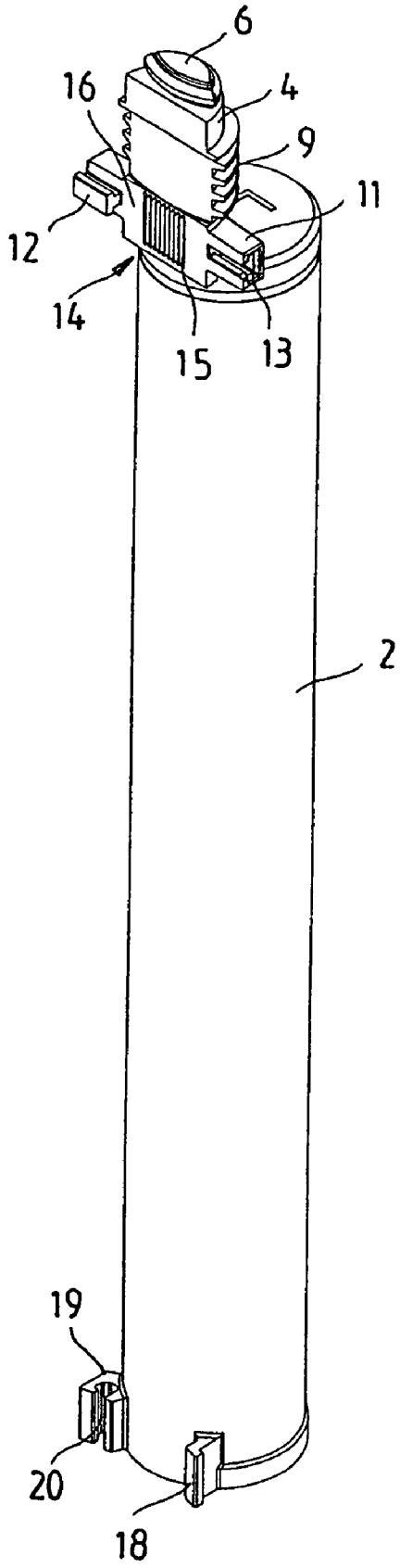
FIG. 3 illustrates a perspective view of an individual cartridge container of the multicomponent cartridge assembly shown in FIG. 1.
Figure 4:
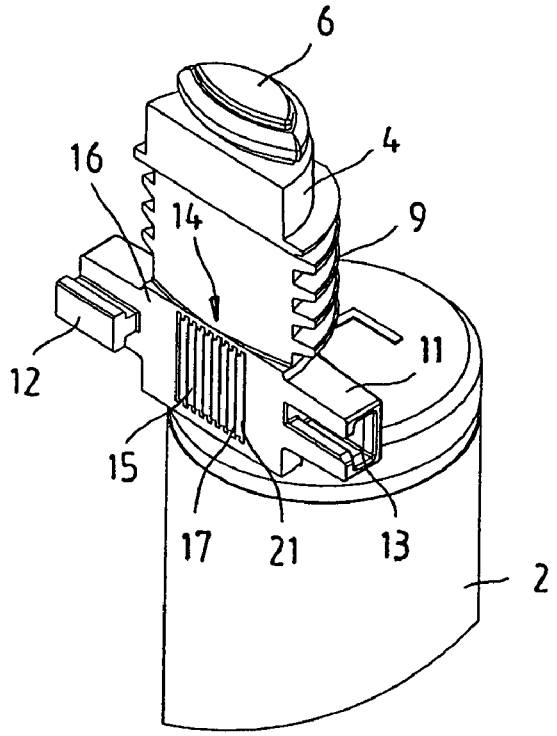
FIG. 4 illustrates a perspective view of the upper part of the cartridge container of FIG. 3.

Referring to FIGS. 3 and 4, the upper connection elements of the cartridge container 2 consist of a T-shaped nose 12 shaped on the one side of the transverse web 11 and a T-shaped groove 13 matching the nose 12 at the opposite side of the transverse web 11. Corresponding connection elements are also provided on the transverse web 10 of the other cartridge container 1 so that the T-shaped nose 12 of the one cartridge container fits into the T-shaped groove 13 of the other cartridge on the plugging together of the two cartridge containers 1,2. A sliding connection transverse to the longitudinal axes of the cartridge containers 1,2 is thereby created.

An additional latch device 14 is provided on the two cartridge containers 1 and 2 in the region of the upper connection elements 12,13 for the secure holding of the two cartridge containers 1,2 in the plugged-together state. The latch device 14 in the embodiment shown consists of mutually corresponding latch tooth arrangements 15 which are arranged on mutually facing straight side surfaces 16 of the cartridge necks 3,4.

As shown In FIG. 4, the latch tooth arrangement 15 is arranged on the cartridge neck 4 of the cartridge container 2 between the two connection elements 12,13. A corresponding latch tooth arrangement 15 is provided on the cartridge neck 3 of the cartridge container 1. As can, in particular, be seen from FIG. 4, the latch tooth arrangement 15 is configured in the manner of a saw tooth arrangement whose teeth have a flatter front side 21 and a steeply falling rear side 17 viewed in the direction of movement on the plugging together of the cartridge containers 1,2. The two cartridge containers 1,2 can thereby be plugged together simply in the upper region transversely to their longitudinal axes, but can no longer be separated.

Figure 5:
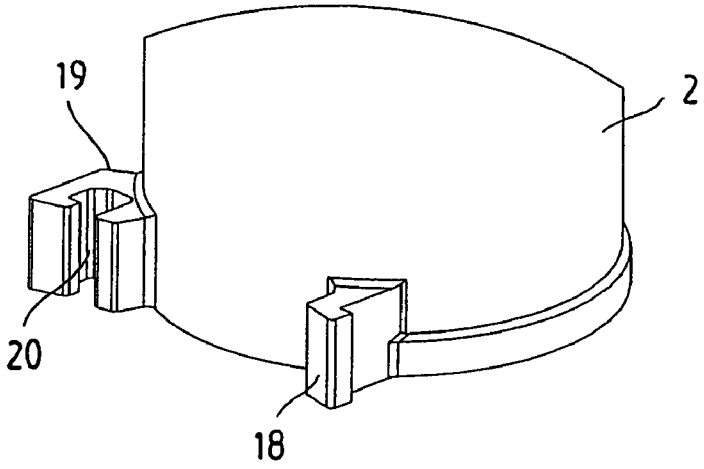
FIG. 5 illustrates a perspective view of the lower part of the cartridge container of FIG. 3.

Referring to FIG. 5, the lower connection elements on the cartridge container 2 consist in each case of a connection spigot 18 shaped on the side wall of the cartridge containers 1,2 and angled to the side and a receiver 19 spaced apart laterally therefrom with a receiver opening 20 matched to the shape of the connection spigot 18. Here, too, corresponding connection elements are attached to the other cartridge container 1 so that the two cartridge containers 1,2 can be plugged together simply axially in the rear region.

For the assembly of the multicomponent cartridge assembly, the two cartridge containers 1,2 are first pushed into one another in the axial direction with their connection elements 18,19 at their rear ends. Subsequently, the T-shaped nose 12 is introduced into the associated T-shaped groove 13 by a pivot movement of one of the cartridge containers. The latch tooth arrangements 15 also come into engagement and provide a secure hold.

The invention is not restricted to the embodiment described above and shown in the drawing. The latch tooth connections or another suitable latch device can thus not only be arranged in the region of the upper connection elements, but also in the region of the lower connection elements or also at the upper and lower connection elements.

The invention thus provides a multicomponent cartridge assembly that can be manufactured simply and that ensures a secure connection between the cartridge containers of the assembly.

What is claimed is:

1. A multicomponent cartridge assembly comprising at least two cartridge containers disposed next to one another;

connection elements disposed in longitudinally spaced apart relation on each of said cartridge containers for interconnecting with respective connection elements on the other of said cartridge containers to connect said cartridge containers together in interconnected relation; and a latch device in a region of at least one pair of interconnecting connection elements for the secure holding of said cartridge containers in said interconnected relation, each said latch device including mutually corresponding latch tooth arrangements on each of said cartridge containers, each said latch tooth arrangement being configured in the manner of a saw tooth arrangement with teeth having a flatter front side and a steeply falling rear side viewed in the direction of movement of said cartridge containers upon interconnecting together.

2. A multicomponent cartridge assembly in accordance with claim 1 wherein each said cartridge container has a neck at one end thereof having a flat side surface facing a flat side surface on said neck of the other of said cartridge containers and wherein said mutually corresponding latch tooth arrangements are arranged on said respective mutually facing side surfaces.

3. A multicomponent cartridge assembly in accordance with claim 1 wherein the upper connection elements of said connection elements of said cartridge containers are configured for the interconnection of said cartridge containers transversely to the respective longitudinal axes of said cartridge containers and the lower connection elements of said connection elements of said cartridge containers are configured for the interconnection of said cartridge containers in a direction parallel to said longitudinal axes.

4. A multicomponent cartridge assembly in accordance with claim 1 wherein each said upper connection element includes a T-shaped nose at one side of a transverse web and of a T-shaped groove matching said nose at an opposite side of said transverse web.

5. A multicomponent cartridge assembly in accordance with claim 1 wherein each of said lower connection elements includes a connection spigot at a side wall of respective cartridge container and a receiver spaced apart laterally therefrom with a receiver opening matched to receive said connection spigot therein.

6. A multicomponent cartridge assembly in accordance with claim 1 wherein each said cartridge container has a neck at an upper end thereof in the shape of a half-cylinder and having a dispensing opening therein.

7. A multicomponent cartridge assembly in accordance with claim 6 wherein said cartridge necks of said cartridge containers form a cylindrical connection stub for a mixer element.

8. A multicomponent cartridge assembly in accordance with claim 6 wherein each said cartridge neck has a partial thread on an outer side thereof complementary to an external partial thread on the other of said cartridge necks with said cartridge containers in interconnected relation.

9. A multicomponent cartridge assembly comprising a pair of cartridge containers disposed next to one another;

upper connection elements on said cartridge containers configured for the interconnection of said cartridge containers transversely to respective longitudinal axes of said cartridge containers;

lower connection elements on said cartridge containers configured for the interconnection of said cartridge containers in a direction parallel to said longitudinal axes; and a latch device in the region of said upper connection elements for the secure holding of said cartridge containers in said interconnected relation, each said latch device including mutually corresponding saw tooth arrangements with teeth having a flatter front side and a steeply falling rear side viewed in the direction of movement of said cartridge containers upon interconnecting together.

10. A multicomponent cartridge assembly in accordance with claim 9 wherein each said upper connection element include a T-shaped nose at one side of a transverse web and of a T-shaped groove matching said nose at an opposite side of said transverse web.

11. A multicomponent cartridge assembly in accordance with claim 9 wherein each of said lower connection elements includes a connection spigot at a side wall of respective cartridge container and a receiver spaced apart laterally therefrom with a receiver opening matched to receive said connection spigot therein.

* * * * *